US009587875B2

(12) United States Patent
Cresswell et al.

(10) Patent No.: US 9,587,875 B2
(45) Date of Patent: Mar. 7, 2017

(54) REAR DOOR INFLATABLE DEVICE FOR AN INTEGRATED REFRIGERATED CONTAINER

(71) Applicant: CARRIER CORPORATION, Farmington, CT (US)

(72) Inventors: Kenneth Cresswell, Cazenovia, NY (US); Yu H. Chen, Manlius, NY (US); Wolfgang Graaff, Hildesheim (DE)

(73) Assignee: CARRIER CORPORATION, Farmington, CT (US)

( * ) Notice: Subject to any disclaimer, the term of this patent is extended or adjusted under 35 U.S.C. 154(b) by 273 days.

(21) Appl. No.: 14/370,388

(22) PCT Filed: Jan. 3, 2013

(86) PCT No.: PCT/US2013/020017

§ 371 (c)(1),
(2) Date: Jul. 2, 2014

(87) PCT Pub. No.: WO2013/103636

PCT Pub. Date: Jul. 11, 2013

(65) Prior Publication Data

US 2014/0338375 A1 Nov. 20, 2014

Related U.S. Application Data

(60) Provisional application No. 61/583,318, filed on Jan. 5, 2012.

(51) Int. Cl.
*F25D 17/06* (2006.01)
*F25D 23/00* (2006.01)
(Continued)

(52) U.S. Cl.
CPC ..... *F25D 23/00* (2013.01); *B65D 88/745* (2013.01); *E06B 7/2318* (2013.01);
(Continued)

(58) Field of Classification Search
CPC ..... F25D 17/065; F25D 2400/04; F25D 2331/804; F25D 3/08
(Continued)

(56) References Cited

U.S. PATENT DOCUMENTS 3,362,179 A * 1/1968 Kirkpatrick ..... F25B 39/02 62/239
3,386,260 A * 6/1968 Kirkpatrick ..... B60P 3/20 165/41
(Continued)

FOREIGN PATENT DOCUMENTS

CN 2295710 Y 10/1998
CN 1320545 A 11/2001
(Continued)

OTHER PUBLICATIONS

Chinese First Office Action for application CN 20130004803.8, dated Jun. 3, 2015, 5 pages.
(Continued)

*Primary Examiner* — Melvin Jones
(74) *Attorney, Agent, or Firm* — Cantor Colburn LLP

(57) ABSTRACT

A method for reducing air leakage from a refrigerated container includes positioning at least one inflatable device about a rear end of the refrigerated container; coupling the at least one inflatable device to one end of an elongated duct located within an interior space of the refrigerated container; coupling a second end of the elongated duct to an outlet port of the evaporator fan; circulating, via the evaporator fan, air through the interior space; and extracting the circulated air through the elongated duct and into the at least one inflatable device.

20 Claims, 3 Drawing Sheets

(51) Int. Cl.

| | |
|---|---|
| ***B65D 88/74*** | (2006.01) |
| ***F25D 11/00*** | (2006.01) |
| ***E06B 7/23*** | (2006.01) |

(52) U.S. Cl.
CPC ..... *F25D 11/003* (2013.01); *F25D 2317/063* (2013.01); *F25D 2323/062* (2013.01)

(58) Field of Classification Search
USPC ..... 62/89, 371, 407, 416, 417, 426
See application file for complete search history.

(56) References Cited

U.S. PATENT DOCUMENTS

| | | | |
|---|---|---|---|
| 3,552,466 | A | 1/1971 | Fairchilds |
| 3,747,954 | A | 7/1973 | Enochian |
| 3,847,091 | A | 11/1974 | Holt |
| 3,872,799 | A | 3/1975 | Dousset |
| 4,089,273 | A | 5/1978 | Guins |
| 4,516,906 | A | 5/1985 | Krein |
| 4,591,519 | A | 5/1986 | Liebel |
| 5,466,104 | A | 11/1995 | Gatwood |
| 5,833,413 | A | 11/1998 | Cornelius |
| 6,945,071 | B1 | 9/2005 | Simeone et al. |
| 7,871,229 | B2 | 1/2011 | Haddard et al. |
| 2006/0210373 | A1 | 9/2006 | Khattab |
| 2006/0239791 | A1 | 10/2006 | Morris |
| 2008/0056839 | A1 | 3/2008 | Maresh et al. |
| 2010/0303387 | A1 | 12/2010 | Dahlquist |
| 2010/0316461 | A1 | 12/2010 | Huchler |

FOREIGN PATENT DOCUMENTS

| | | | |
|---|---|---|---|
| CN | 2739139 | Y | 9/2005 |
| CN | 201254364 | Y | 6/2009 |
| CN | 101670924 | A | 3/2010 |
| DE | 202006001736 | U1 | 4/2006 |
| EP | 2019274 | A1 | 1/2009 |
| WO | 2011112500 | | 9/2011 |

OTHER PUBLICATIONS

Chinese Search Report Action for application CN 201380004803.8, dated May 25, 2015, 3 pages.
Notification of Transmittal of the International Search Report of the International Searching Authority, or the Declaration; PCT/US2013/020017; Mar. 18, 2013.
Notification of Transmittal of the International Written Opinion of the International Searching Authority, or the Declaration; PCT/US2013/020017; Mar. 18, 2013.

* cited by examiner

REAR DOOR INFLATABLE DEVICE FOR AN INTEGRATED REFRIGERATED CONTAINER

CROSS-REFERENCE TO RELATED APPLICATIONS

This Application is a National Stage of International Application No. PCT/US13/020017 filed Jan. 3, 2013, which claims the benefit of U.S. provisional application, Application No. 61/583,318, filed Jan. 5, 2012, which is herein incorporated by reference.

FIELD OF INVENTION

This invention relates generally to a transport refrigeration system and, more particularly, to an inflatable seal or flexible tube that is disposed on, around, or near the rear door opening of a refrigerated shipping container or trailer for providing a seal against leakage and is inflated with air from an evaporator fan of the transport refrigerated system.

DESCRIPTION OF RELATED ART

Products such as produce, meat and the like being shipped relatively long distances are conventionally placed within refrigerated containers. These refrigerated containers are specifically designed for conditioning an interior space with refrigerated air for an extended period of time. These refrigerated containers utilize a transport refrigeration unit for cooling these products with refrigerated air during transport. The refrigeration unit is typically secured to the front wall of the refrigerated container and circulates cooled air inside the interior space through evaporator fans, which direct the air from the front of the container to the rear.

Typically, insulation and air leakage is a concern when shipping produce and/or meats in these refrigerated containers. An area of concern is the rear door as it tends to be furthest away from the refrigeration cooling unit, which is located at the front of the refrigerated container. In some cases, seals and hinges on the rear door wear out over time causing the refrigerated air to leak out and prevent produce or meat at the rear door from being maintained at an optimal temperature. This air leakage tends to increase the rate of spoilage of the produce or meats. Additionally, air leakage can interfere with controlling the refrigeration unit and/or change the humidity of the controlled atmosphere surrounding the area of the leak by changing percentages of gas components in its vicinity such as, for example, the percentage of nitrogen in the area of the leak.

BRIEF SUMMARY

According to one aspect of the invention, an air sealing system for a refrigerated container, includes an evaporator fan configured for circulating air flow through an interior space of the refrigerated container; an inflatable device that is flexible and is configured to be positioned about a rear end of the refrigerated container; and an elongated duct coupled at a first end to the inflatable device and a second end to an outlet port of the evaporator fan, the elongated duct being configured for extracting the circulated air flow and communicating the extracted air flow into the inflatable device.

According to another aspect of the invention, a method for reducing air leakage from a refrigerated container includes positioning an inflatable device about a rear end of the refrigerated container; coupling the inflatable device to one end of an elongated duct located within an interior space of the refrigerated container; coupling a second end of the elongated duct to an outlet port of the evaporator fan; circulating, via the evaporator fan, air through the interior space; and providing a portion of the through the elongated duct and into the inflatable device.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the FIGURES.

DETAILED DESCRIPTION

Embodiments of an integrated refrigerated container include an inflatable device such as, for example, an inflatable seal or an inflatable flexible tube that is disposed on, around, or near the rear doors of a cargo container. In embodiments, the inflatable seal or flexible tube can be disposed in the sidewall of the refrigerated container around the rear door or inside the rear door along its perimeter. In an embodiment, the inflatable seal may be removable from the sidewall and be replaceable with another inflatable seal or be reusable with the same inflatable seal (i.e., the inflatable seal may be used one time or may be reusable). The inflatable seal or flexible tube may be connected to an elongated duct emanating from an outlet of an evaporator fan for bleeding air from the evaporator fan in order to selectively inflate the inflatable seal. Additionally, a check valve may be coupled to the inflatable seal or flexible tube that is in line with the elongated duct for preventing the inflatable seal or flexible tube from deflating when the evaporator fan is not running. The inflatable seal or flexible tube, once inflated, provides additional insulation of the interior space of the cargo container as well as forming a seal between the interior space and the rear doors in order to prevent or minimize refrigerated air from escaping out of the interior space into the ambient environment.

Figure 1:
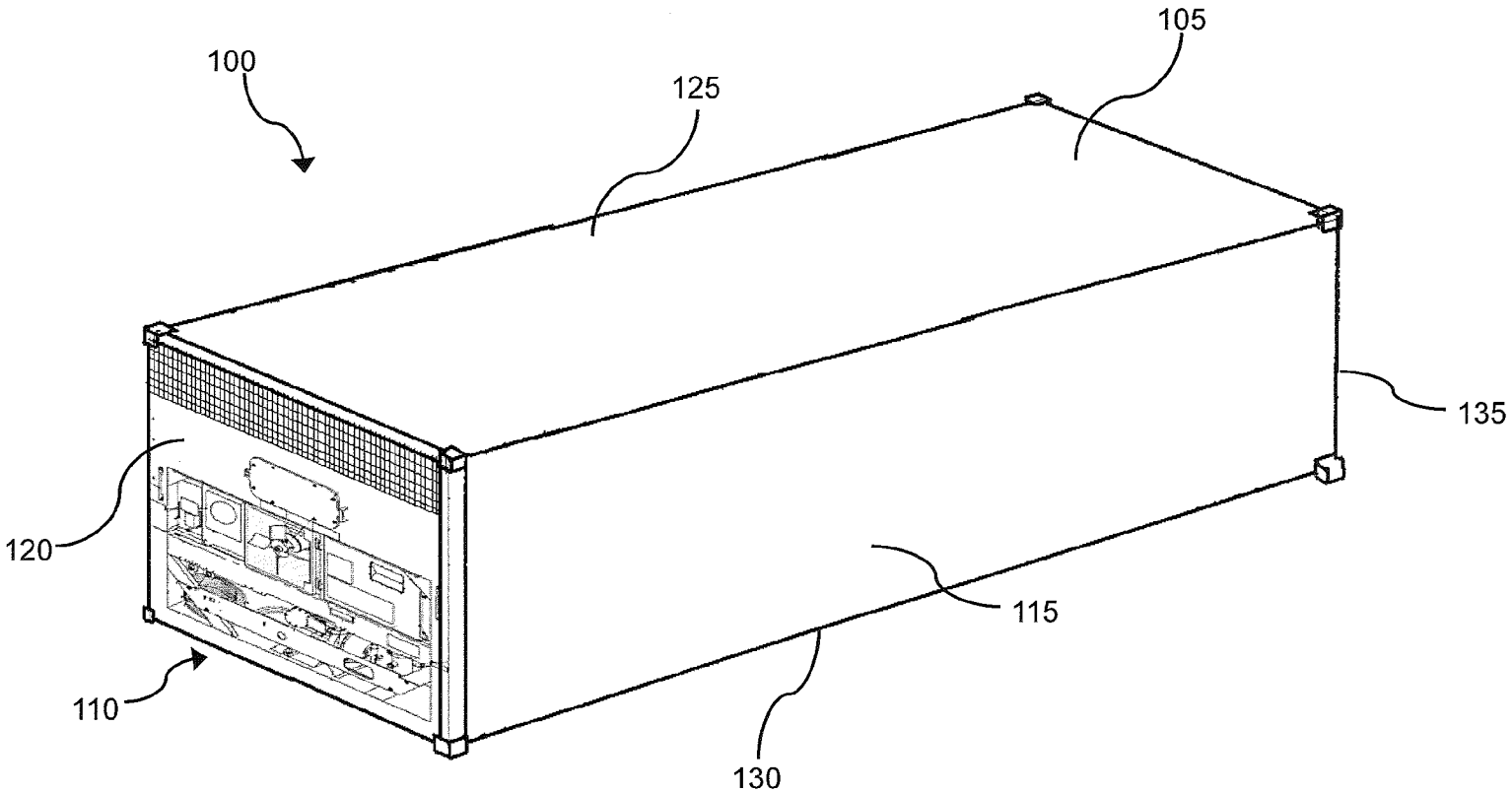
FIG. 1 illustrates a perspective view of an integrated container with a refrigeration system according to an embodiment of the invention.

FIG. 1 illustrates an example of an integrated refrigerated container 100 including a cargo container 105 coupled to a refrigeration system 110 for providing space cooling of the cargo container 105. The cargo container 105, which may be formed into a generally rectangular construction, and includes opposed side walls 115, a front wall 120, a top wall 125, a directly opposed bottom wall 130, and a door or doors (not shown) attached on hinges at the rear end 135. The walls 115-130 may be formed, for example, from welded corrugated steel or aluminum to provide significant strength and structural integrity. In an example, the integrated refrigerated container 100 may be approximately twenty feet in length and a width and height of approximately eight feet. However, these dimensions may vary depending on the particular environment in which the integrated refrigerated container 100 is utilized. The cargo container 105 includes a front cavity 200 (FIG. 2) at the front wall 120 for housing the components of the refrigeration system 110, which is provided for cooling interior space 250 (FIG. 2) enclosed by the walls 115-130.

Figure 2A:
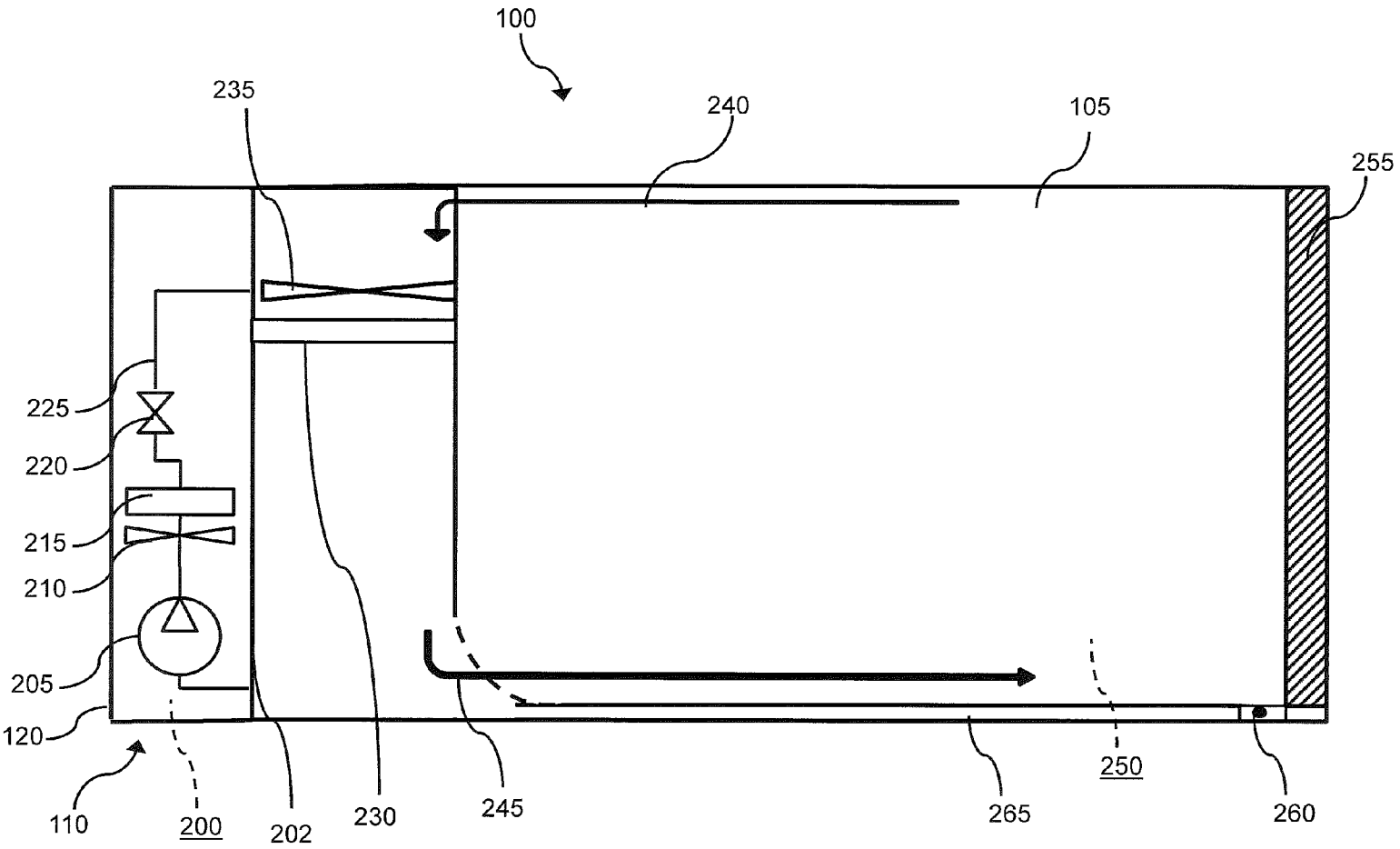
FIG. 2A illustrates a schematic side view of the integrated container with an inflatable seal according to an embodiment of the invention.
Figure 2B:
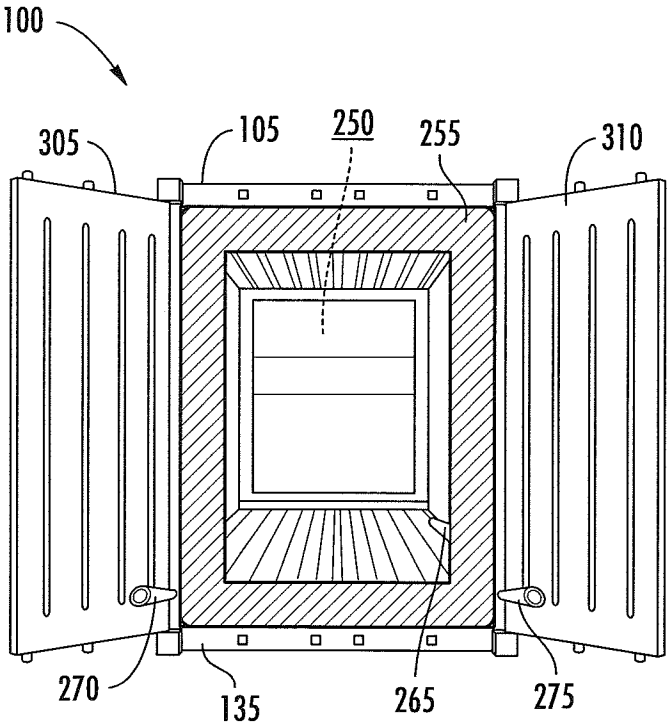
FIG. 2B illustrates an elevation view of the inflatable seal shown in FIG. 2A but with the seal positioned around the rear door of the integrated container according to an embodiment of the invention.

FIGS. 2A-2B illustrate an embodiment of the integrated refrigerated container 100 having an inflatable device such as, for example, an inflatable seal 255 that can be selectively inflated. The inflatable seal 255 may, in one example, be tubular and have a generally rectangular shape, and is fastened at or around the rear doors with hooks, pins, tape, hook and loop fasteners such as Velcro™ fasteners, or any other similar types of fasteners that facilitates ease of attachment to the container 100 or removal and replacement upon damage to the inflatable device. In another embodiment, an inflatable flexible tube (not shown) with a length that is bent to follow the perimeter of the interior walls can also be used without departing from the scope of the invention. In the example shown in FIGS. 2A-2B, the inflatable seal 255 can be formed from a polyurethane material that is flexible and elastic in an inflated or deflated state. In other embodiment for example, the inflatable seal 255 can be made of any conventional film grade polymeric compositions, including polyolefins such as high density polyethylene, low density polyethylene, polypropylene and blends thereof, film grade vinyl polymer as well as natural polymeric material, high density polypropylene (HDPP), polyvinyl chloride (PVC), or the like that can be inflated with air pressure from that provided by the evaporator fan 235. As shown in FIGS. 2A-2B, the inflatable seal 255 includes an inlet port, which is coupled to a check valve 260 at one end. Also, the check valve 260 is configured to be coupled, at its second end, to an outlet of the evaporator fan 235 via an elongated duct 265. The elongated duct 265 facilitates air flow from the evaporator fan 235 to be diverted through the duct 265 in order to inflate the inflatable seal 255. In an embodiment, the check valve 260 may be a spring-loaded check valve having a ball coupled to an internal spring that allows flow of air in one direction via the spring-loaded ball although, in another example, a flap that opens under pressure may also be used. In an embodiment, the check valve 260 may include a release valve for manually deflating the inflatable seal 255. In addition, it is contemplated that the release valve may be configured to automatically deflate the seal. In another embodiment, the inflatable seal 255 can be selectively deflated through a release valve coupled to the seal 255 that can be manually engaged in order to let air out of the interior of the seal 255. The inflatable seal 255 may be positioned adjacent (e.g., at or around) the rear doors and be selectively inflated from its deflated state and expand along the interior walls of the cargo container 105 in order to maintain a seal along the perimeter of the internal walls at or near the rear doors (not shown) of the cargo container 105 while also increasing the insulation of the cargo container 105. In an embodiment, the inflatable seal 255 can be sized according to the internal dimensions of the rear door (not shown) of the cargo container 105. In an embodiment, the seal 255 may be removable from the sidewall of cargo container 105 and/or be replaceable upon damage (i.e., the inflatable seal may be used one time or may be reusable). In an embodiment, the inflatable seal 255 can include holes of a predetermined diameter along its surface in order to define the amount of air that is leaked from the seal 255 in an area around or near the rear door. This air leakage can provide refrigerated air or mixed gases at or around the rear door and supports cooling of the interior space 250 or controlled gas supply to the area at or around the rear door. The inflatable seal 255 can be attached to one or more interior walls of the cargo container 105 so as to prevent dislocation of the seal 255 during transport.

Also shown in FIG. 2A, the refrigeration system 110 may include an electrically driven refrigeration compressor 205 connected, via a refrigerant line 225, to a condenser coil 215, a condenser blower 210, an expansion valve 210, an evaporator coil 230 and the evaporator fan 235. The compressor 205, condenser coil 215, condenser fan 210, and expansion valve 210 are positioned in the front cavity 200, which is exposed to the external ambient environment. Also, the compressor 205, condenser coil 215, condenser fan 210, and expansion valve 210 are separated from the interior space 250 by an insulating wall 202, while the evaporator fan 235 and the evaporator coil 230 are located within the interior space 250. The evaporator fan 235 cooperates with the evaporator coil 230 to refrigerate the air within the interior space 250 by circulating air flow over the evaporator coil 230 along paths 240, 245. Additionally, the evaporator fan 235 circulates air flow through the elongated duct 265 in order to inflate the inflatable seal 255 and increase the insulation of the cargo container 205 as well as form a seal between the rear end 135 (FIG. 1) and the rear doors (not shown). During operation of the refrigeration system 100, the elongated duct 265 routes air from the evaporator fan 235 into the inflatable seal 255 when the evaporator fan 235 is circulating air through the interior space 250. Further, the check valve 260 causes the inflatable seal 255 to maintain its inflated state by preventing air from escaping out of the inflatable seal 255 when the evaporator fan 235 is not circulating air through the elongated duct 265 such as, for example, when the evaporator fan 235 cycles to "low speed" or is off.

As shown in FIG. 2B, the inflatable seal 255 is configured for being positioned at or near the rear doors 305, 310 at rear end 135 and be selectively inflated by airflow flowing through the elongated duct 265 that is bled from evaporator fan 235. The inflatable seal 255, once inflated, expands along the interior walls of the cargo container 105 and maintains a seal with the rear doors 305, 310 along the perimeter of the internal walls at or near the rear doors 305, 310 of the cargo container 105 while also increasing the insulation of the cargo container 105. In another embodiment, additional ducts 270, 275 can be provided at or around the rear doors 305, 310 for inflating additional flexible tubes or seals. In another embodiment, cargo container 105 may include two seals (not shown), substantially similar to seal 255, positioned about each of the rear doors 305, 310. In another embodiment, the two seals positioned about each rear door 305, 310 may be located in a deflated condition and stored within a cavity in the respective doors 305, 310 in order to protect the seals from puncture. Upon inflation, the seals would extend from the door 305, 310. It is to be appreciated that the inflatable seal 255 can facilitate ease of opening the rear doors from their closed position by reducing the vacuum formed by the cold refrigerated air within interior space 250.

Figure 3:
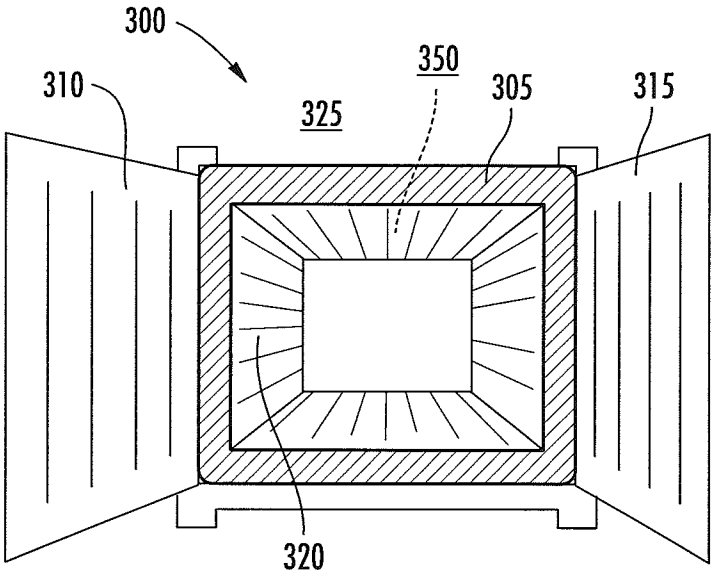
FIG. 3 illustrates an elevation view of the inflatable seal but with the seal positioned in the sidewall around the rear door of the integrated container according to an embodiment of the invention.

In an example, illustrated in FIG. 3, an inflatable device such as, for example, an inflatable seal 305 is incorporated into the walls of the refrigerated container 300 according to an embodiment of the invention. Particularly, the inflatable seal 305 is positioned at or near doors 310, 315 and is incorporated between an exterior sheet metal panel (not shown) that is adjacent to the ambient environment 325, and an interior liner 320, adjacent to the interior space 350 being conditioned, while all other aspects remain substantially the same as those of integrated refrigerated container 100 that is shown and illustrated in FIGS. 1-2B. The inflatable seal 305 is configured to be selectively inflated by refrigerated air flowing through an elongated duct (not shown) that is bled from an evaporator fan (not shown). The inflatable seal 305, once inflated, expands outwardly towards the rear doors 310, 315 and maintains a seal along the perimeter of around or near the rear doors 305, 310 when the rear doors 305, 310 are closed.

The technical effects and benefits of embodiments relate to an inflatable seal that is located at or near the rear doors of a cargo container. The inflatable seal includes an elongated duct connected to the outlet of an evaporator fan for bleeding air from the evaporator fan in order to inflate the inflatable duct. Additionally, a check valve coupled to the inflatable seal and in line with the elongated duct prevents the inflatable duct from deflating when the evaporator fan cycles to low speed or is off.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air sealing system for a refrigerated container, comprising:

an evaporator fan configured for circulating a circulated air flow through an interior space of the refrigerated container;

at least one inflatable device that is flexible and is configured to be positioned about a rear end of the refrigerated container; and an elongated duct comprising a first end coupled to the at least one inflatable device and a second end positioned to extract from the circulated air flow an extracted air flow and communicate the extracted air flow into the at least one inflatable device.

2. The system of claim 1, wherein the at least one inflatable device resides within the interior space of the refrigerated container.

3. The system of claim 1, wherein the refrigerated container includes two inflatable seals positioned about each rear door of the refrigerated container.

4. The system of claim 1, further comprising a check valve coupled to the first end of the elongated duct.

5. The system of claim 1, further comprising a reverse valve configured for removing air from the at least one inflatable device, the reverse valve being coupled to the inflatable seal.

6. The system of claim 1, wherein the check valve is a one-way valve configured for communicating air from the evaporator fan to the at least one inflatable device during operation of the evaporator fan.

7. The system of claim 6, wherein the check valve is configured for preventing air from flowing out of the at least one inflatable device while the evaporator fan cycles to low speed or is not operating.

8. The system of claim 1, wherein the evaporator fan is configured for circulating cooled air within the interior space.

9. The system of claim 1, further comprising a compressor for conditioning a refrigerant flowing through a refrigerant line.

10. The system of claim 9, wherein the refrigerant line is configured for circulating the refrigerant through an evaporator coil in response to the cooling of the interior space.

11. The system of claim 1, wherein the at least one inflatable device is an inflatable seal or an inflatable tube.

12. The system of claim 1, wherein the at least one inflatable device is configured for ease of attachment to the refrigerated container or ease of removal from the refrigerated container.

13. A method for reducing air leakage from a refrigerated container, comprising:

positioning at least one inflatable device about a rear end of the refrigerated container;

coupling the at least one inflatable device to one end of an elongated duct located within an interior space of the refrigerated container;

positioning a second end of the elongated duct to receive an outlet of the evaporator fan;

circulating, via the evaporator fan, circulated air through the interior space; and extracting extracted air from the circulated air and directing the extracted air through the elongated duct and into the at least one inflatable device.

14. The method of claim 13, wherein the coupling of the at least one inflatable device to the one end further comprises coupling the one end to a check valve to the at least one inflatable device.

15. The method of claim 13, further comprising positioning two inflatable seals about each rear door of the refrigerated container.

16. The method of claim 13, further comprising removing air from the at least one inflatable device via a reverse valve, the reverse valve being coupled to the at least one inflatable device.

17. The method of claim 13, wherein the check valve is a one-way valve configured for moving air from the evaporator fan to the at least one inflatable device during operation of the evaporator fan.

18. The method of claim 17, wherein the check valve is configured for preventing air from flowing out of the at least one inflatable device into the elongated duct while the evaporator fan cycles to low speed or is not operating.

19. The method of claim 13, further comprising circulating cooled air within the interior space.

20. The method of claim 19, further comprising circulating refrigerant through an evaporator coil in response to the cooling of the interior space.

* * * * *